US005184737A

United States Patent [19]

Hardy

[11] Patent Number: 5,184,737

[45] Date of Patent: Feb. 9, 1993

[54] DISPLAY SYSTEM HAVING SUSPENDED CHANNELS AND METHOD OF ASSEMBLY

[75] Inventor: Stephen N. Hardy, Copley, Ohio

[73] Assignee: American Greetings Corporation, Cleveland, Ohio

[21] Appl. No.: 719,194

[22] Filed: Jun. 21, 1991

[51] Int. Cl.[5] ..... A47F 5/00

[52] U.S. Cl. ..... 211/55; 211/88

[58] Field of Search ..... 211/55, 56, 87, 88, 211/90, 128

[56] References Cited

U.S. PATENT DOCUMENTS

| | | | |
|---|---|---|---|
| 2,609,937 | 9/1952 | Rubenstein | 211/106 |
| 3,139,186 | 6/1964 | George | 211/55 |
| 3,285,424 | 11/1966 | Emery | 211/55 |
| 5,009,335 | 4/1991 | Jonker | 211/55 |

*Primary Examiner*—Robert W. Gibson, Jr.
*Attorney, Agent, or Firm*—Calfee, Halter & Griswold

[57] ABSTRACT

An adjustable display system comprises a plurality of separate, laterally extending channels adapted to be supported in adjacent, side-by-side relation. Each channel has parallel front and rear rails extending upwardly from a bottom shelf to form a J-shaped design. Adjacent channels are coupled together by pairs of suspension clips. Each suspension clip includes a pair of prongs interconnected by a cross member. One prong of each clip is attached to a socket formed in the rear rail of one channel, while the other prong of each clip is attached to a socket formed in the rear rail of an adjacent channel. Each channel further includes a divider structure extending along the length of the rear rail. The divider structure is adapted to receive divider members to divide each channel into a plurality of sections. A first of the channels in the display system is connected to a hanger bracket which supports the coupled channels on an upright structure for display of products.

28 Claims, 4 Drawing Sheets

DISPLAY SYSTEM HAVING SUSPENDED CHANNELS AND METHOD OF ASSEMBLY

TECHNICAL FIELD

The present invention relates to a display system comprising a plurality of separate, laterally extending channels supported in adjacent, side-by-side relation.

BACKGROUND OF THE INVENTION

A popular type of merchandise display system consists of a support structure having staggered, offset rows of shelves to support and display products in a tiered fashion. The merchandise display system enables consumers to remove individuals products from the shelves and inspect the products prior to purchase. The shelves maintain the products in a neat, orderly fashion, and can include divider members for dividing the shelves into sections.

For example, one type of display system is shown in U.S. Pat. No. 4,796,764, which is owned by the assignee of this invention. The '764 display system comprises a staggered, vertical array of display shelves formed both forwardly and rearwardly of display walls. A plurality of dividers can be secured to the display walls to divide both the forward and rearward side of the shelves into sections of a preselected size.

Another type of display system is shown in U.S. Pat. No. 4,949,849, also owned by the assignee of the present invention. The display system shown in the '849 patent includes a supporting structure having a plurality of central dividers interposed between left and right end dividers. Each divider comprises an integrally formed, vertically tiered structure having a plurality of shelves for support of greeting cards. The dividers separate adjacent columns of greeting cards and are adjustable to support and display greeting cards of different widths.

Although the above-identified display systems provide shelves for supporting and displaying products in a vertically tiered fashion, the display systems can require significant molding and/or forming of the support structure and shelves during manufacture; and significant assembly of the structure at the point of display, all of which can increase the overall cost of the display system.

For example, the '849 patent includes front and back posts which must be preassembled to a base; and a plurality of horizontal arm extensions and support means which must be attached to the posts before the central, left, and right end dividers are located on the supporting structure. Manufacturing and assembling these components can increase the cost of the display system. Moreover, the central, left and right end dividers have a plurality of shelves which must be formed in one piece; or alternatively, formed separate from the dividers and then attached, by e.g., adhesives. The forming and/or attaching of the shelves can also increase the cost of the dividers, and hence the overall cost of the display system. Further, the number of shelves in each divider is determined during the forming and/or attaching process, and cannot later be modified at the point of display to reflect the quantity of products to be displayed.

SUMMARY OF THE INVENTION

The present invention provides a new and useful adjustable display system having a plurality of separate, laterally extending channels supported in adjacent, side-by-side relation. The channels are individually formed and can be simply and conveniently assembled at the point of display. Additional channels can be attached to the display system depending upon the quantity of products to be displayed. Further, dividers can be located along the channels to separate the channels into a plurality of sections for support and display of products.

Each channel in the display system includes parallel front and rear rails extending upwardly from a bottom shelf to form a J-shaped design. The rear rail of each channel includes a first and second attachment structure. The first attachment structure comprises a tube extruded integrally with the rear rail and spaced from the bottom shelf of the channel. The tube includes a pair of sockets, with each socket located along opposite ends of the channel. The second attachment structure also comprises a tube formed integrally with a flange projecting downwardly from the rear rail and proximate the bottom shelf of the channel. The second attachment structure also includes a pair of sockets, with each socket located along opposite ends of the channel.

The channels are coupled in adjacent, side-by-side relation with pairs of suspension clips. The suspension clips are attached along opposite ends of the channels to couple the attachment structure of one channel to the attachment structure of an adjacent channel. Each suspension clip includes a pair of prongs interconnected by a cross member. One prong of each clip is received in a socket in the attachment structure in one channel, while the other prong of each clip is received in a corresponding socket in the attachment structure in the adjacent channel. One pair of clips is thereby coupled between the first attachment structures of the adjacent channels; while the other pair of clips is coupled between the second attachment structures of the adjacent channels.

The coupled channels are supported on an upright structure. To this end, one pair of suspension clips on the first channel in the arrangement of channels is supported on a hanger bracket connected to the upright structure. Additionally, a pair of bottom support clips can be attached between the sockets in the second attachment structures on one of the channels and openings in the slotted upright to provide additional support and integrity for the display system.

The suspension clips cooperate to support the channels in adjacent, side-by-side relation in a tiered fashion. The coupled channels are supported on an upright structure for display of products in the channels. Further, by providing additional channels and suspension clips, the display system can support and display additional products. Additional fixtures e.g., posts, brackets or frames, are not necessary to support the channels, even when the additional channels are included.

According to an additional aspect of the invention, each channel includes a divider structure formed integrally along the length of the rear rail. The divider structure is designed to receive divider members at selected locations along the channel. Each divider member comprises an attachment portion adapted to be received within the divider structure, and an outwardly projecting portion which divides each channel into plural sections for support and display of products in a neat and orderly fashion.

Accordingly, it is one feature of the present invention to provide a plurality of laterally extending channels supported in adjacent, side-by-side relation for display of products. The number of channels coupled together in the display system is determined by the amount of product to be displayed.

Another feature of the present invention is to provide a low-cost display system which can be conveniently assembled at the display point, and which requires a minimum of floor space.

Another feature of the present invention is to provide a multi-purpose display system having a plurality of channels to support and display products in a neat and orderly fashion. Divider members can be located along each channel to divide the channels into a plurality of sections for arrangement of the products.

Still another feature of the present invention is to provide a display system having channels which can be linearly extruded using conventional extrusion techniques, and supported in a cascading fashion without the need for additional fixtures.

Further features and advantages of the present invention will become apparent from the following detailed description and the accompanying drawings.

DETAILED DESCRIPTION OF THE PREFERRED EMBODIMENT

Figure 1:
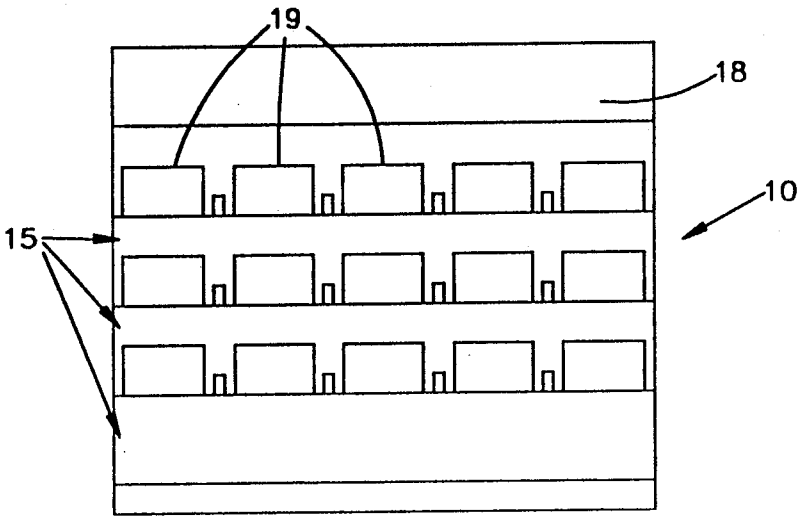
FIG. 1 is a front plan view of a display system constructed according to the present invention.

Referring to the drawings, and initially to FIG. 1, a display system, indicated generally at 10, includes a plurality of laterally extending channels, for example as indicated generally at 15, supported in side-by-side, adjacent relation on an upright support structure 18. The channels are designed to support and display products (e.g., at 19) in a tiered fashion for consumers.

Figure 3:
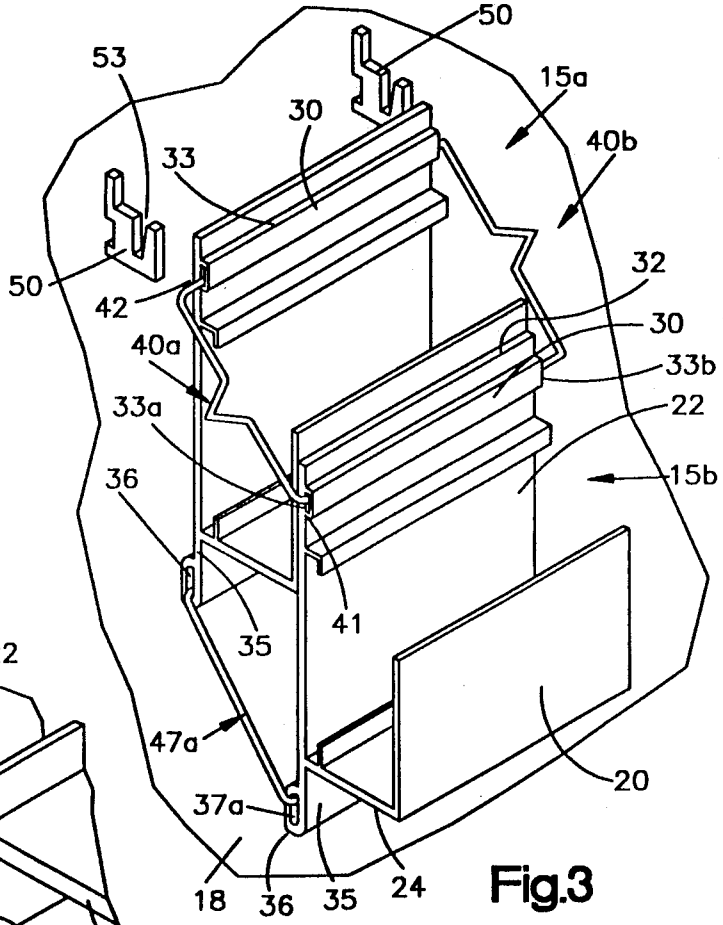
FIG. 3 is a side perspective view of the partially assembled display system of FIG. 1.
Figure 2:
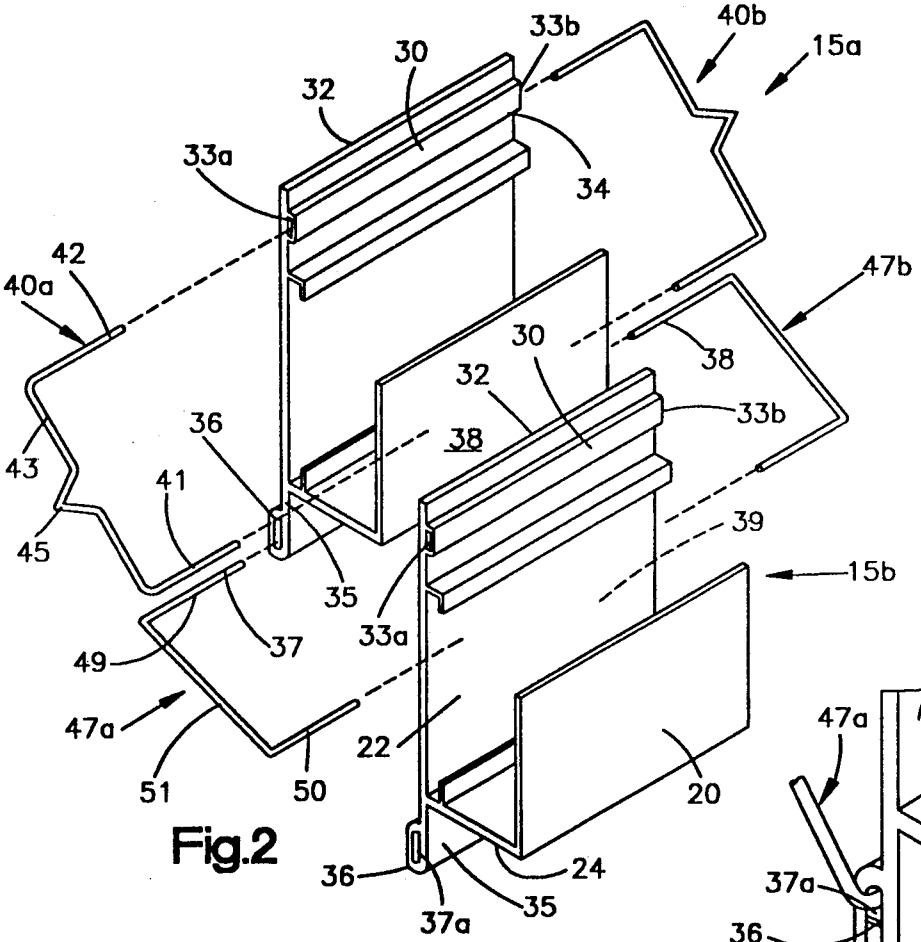
FIG. 2 is a side perspective view of the unassembled display system of FIG. 1.

Referring now to FIGS. 2 and 3, each channel, for example channel 15*b*, includes parallel front and rear rails 20, 22 respectively, extending upwardly from a bottom shelf 24. The shelf 24 is preferably formed at an obtuse angle to rear rail 22, and at an acute angle to front rail 20. The front rail 20, rear rail 22 and shelf 24 form a substantially J-shaped design in cross section.

The front rail 20, rear rail 22 and shelf 24 of each channel are preferably formed from acrylic or other appropriate material and are linearly extruded in one-piece and cut to appropriate lengths. The extrusion techniques for the channels are known to those of ordinary skill in the art and will not be discussed further.

Each channel 15 includes a first attachment structure, indicated generally at 30, formed along the length of the rear rail 22. The first attachment structure 30 comprises a tube formed integrally in the rear rail 22 during the extrusion process. The tube extends along the length of the channel proximate the top edge 32. At each end of the channel, the tube has a socket or opening, indicated at 33*a*, 33*b*, respectively.

Figure 3A:
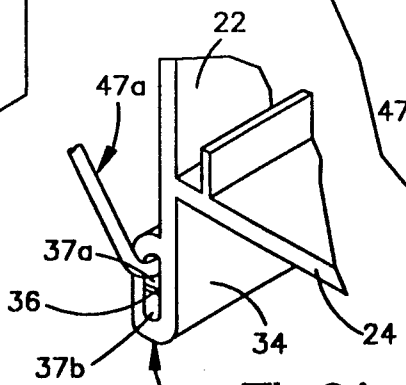
FIG. 3A is an enlarged, partial side perspective view of the second attachment structure shown in FIG. 3.

Each channel further includes a flange 34 which is formed in one piece with and extends downwardly from the rear rail 22 below shelf 24. The flange 34 extends along the length of the rear rail 22 and includes a second attachment structure, indicated generally at 35. The second attachment structure 35 also comprises a tube formed integrally with the flange 34 during the extrusion process. The tube in the second attachment structure, however, is divided down the middle by a cross piece 36 into a top and bottom half (see also FIG. 3A). At each end of the channel, the top and bottom halves have an opening, e.g., indicated at 37*a* and 37*b*, respectively. The techniques for forming the tubes for the first and second attachment structures are also known to those of ordinary skill in the art, and will not be discussed further.

A plurality of channels, for example channels 15*a* and 15*b*, are designed to be supported in adjacent, side-by-side relation to each other. To this end, the outer surface 38 (FIG. 2) on the front rail 20 of channel 15*a* is located adjacent the outer surface 39 (FIG. 2) on the rear rail 22 of channel 15*b*, as shown in FIG. 3. The adjacent channels 15*a*, 15*b* are then coupled together using pairs of suspension clips. In particular, a first pair of suspension clips, indicated generally at 40*a* and 40*b*, are coupled between the sockets in the first attachment structure 30 on channel 15*a* and the sockets in the first attachment structure 30 on adjacent channel 15*b*.

Each suspension clip 40*a*, 40*b* is preferably formed from steel wire and includes a first prong 41 and a second prong 42 interconnected by a cross member 43. The first prong 41 of suspension clip 40*a* is adapted to be received within the socket 33*a* formed in the first attachment structure 30 in one end of channel 15*a*; while the second prong 42 is adapted to be received in the socket 33*a* formed in the first attachment structure 30 on one end of an adjacent channel 15*b*.

Similarly, the second suspension clip 40*b* has a first and second prong 41, 42 and a connecting member 43. The prongs of clip 40*b* are adapted to be received in the socket 33*b* formed in the first attachment structure in the other end of channel 15*a*, and the socket 33*b* formed in the first attachment structure 30 in the other end of adjacent channel 15*b*. The prongs of clips 40*a*, 40*b* extend into the respective tubes formed in the rear rail of the channels, while the cross members abut the tube openings.

A second pair of suspension clips, indicated generally at 47*a*, 47*b*, are similarly adapted to be coupled between the second attachment structure 35 on the adjacent channels 15*a*, 15*b*. Each suspension clip 47*a*, 47*b* is also preferably formed from steel wire and also includes a first prong 49, a second prong 50 and a connecting member 51. The first prong 49 of each clip 47*a*, 47*b* is adapted to be received in the opening (e.g., 37*b*) in the second attachment structure 36 in one end of channel 15*a*; while the second prong 50 is adapted to be received in the opening (e.g., 37*a*) in the second attachment structure 36 in the adjacent channel 15*b*. The prongs of clips 47*a*, 47*b* also extend into the respective tubes formed in the rear rail of the channels, while the cross members abut the tube openings. The channels are thereby secured together in adjacent, side-by-side relation by the suspension clips 40*a*, 40*b*; and 47*a*, 47*b*.

Figure 4:
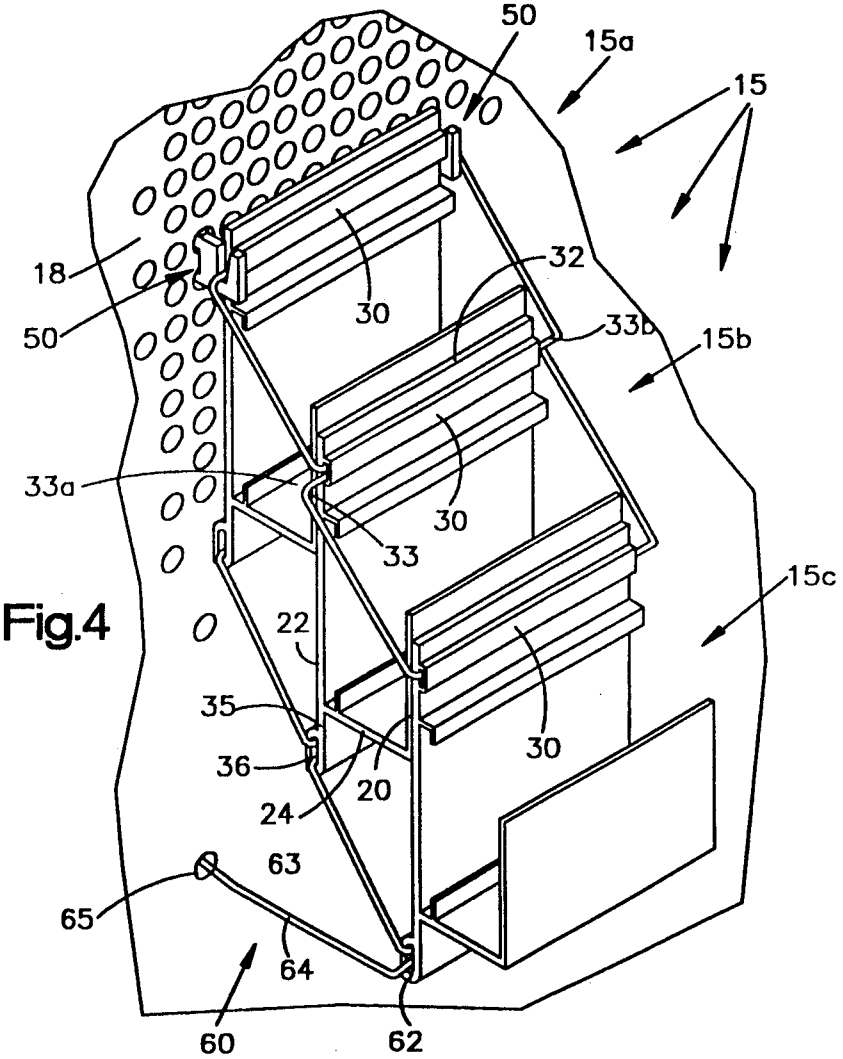
FIG. 4 is a side perspective view of the assembled display system illustrated in FIG. 1.

As shown in FIG. 4, a third channel 15*c* can also be secured in adjoining side-by-side relation to channels 15*a*, 15*b* in a similar manner using an additional pair of suspension clips. Additional channels can be provided in side-by-side relation and additional suspension clips can support the channels in a tiered fashion. Nevertheless, it is also within the scope of this invention to provide only a single channel for support and display of products.

Figure 5:
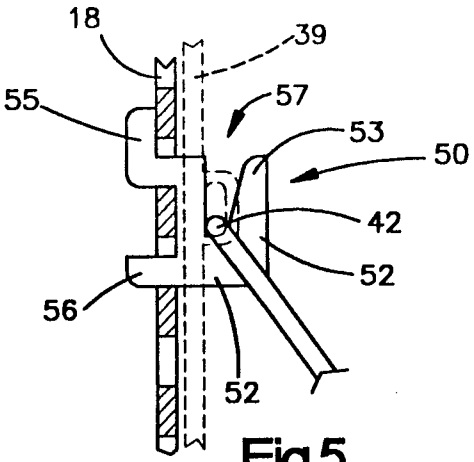
FIG. 5 is an enlarged, cross sectional view of the hanger bracket of FIG. 3, illustrating the hanger bracket attached to the upright structure.

The channels are adapted to be supported on the upright structure 18. The upright structure 18 comprises pegboard or other conventional support structure. The structure includes a plurality of slots or holes (unnumbered) which are designed to receive a hanger bracket, indicated generally at 50. The hanger bracket 50, as shown in more detail in FIG. 5, includes a body 52 preferably formed from sheet steel or other appropriate material. The body 52 has a hook 53 projecting upwardly from one side, and a pair of legs 55, 56 projecting outwardly from the other side. Leg 55 and hook 53 define a groove, indicated generally at 57. The legs 55, 56 are configured to be received in a pair of cooperating slots in the upright structure 18 to support the bracket in a vertical orientation.

A pair of hanger brackets 50 are located in horizontally spaced relation on the upright structure, for example as shown in FIGS. 3 and 4. The groove 57 of each hanger bracket 50 is configured to receive a portion of the first prong 42 of the first pair of suspension clips 40*a*, 40*b*. In particular, after the channels 15 are pre-assembled with the pairs of suspension clips (e.g., FIG. 3), the first prong 42 of suspension clip 40*a* is located over one hanger bracket such that the prong 42 is received and supported within the groove 57. Similarly, the first prong 42 of the suspension clip 40*b* is located over the other hanger bracket 50 on the other side of the channel, and is similarly received and supported in the groove 57.

When the channels 15 are supported on hanger brackets 50, the suspension clips 40*a*, 40*b* coupled between the first attachment structure 30 on the adjacent channels, are put under a tensile force. In particular, the channels tend to fall down and away from each other because of the force of gravity, which thereby puts a tensile force on the cross member 43 of each suspension clip. The clips 40*a*, 40*b*, however, are coupled between the respective attachment structures and resist this force.

Additionally, the suspension clips 47*a*, 47*b*, coupled between the second attachment structure 36 on the adjacent channels, are put under a "compression" force. In particular, as the channels are restrained from falling down and away from each other by clips 40*a*, 40*b*, a moment is applied to the channels which compresses the cross member 51 of each clip 47*a*, 47*b*. The clips 47*a*, 47*b* however, are also coupled between the respective attachment structures and resist this compression force to prevent the channels from sagging over the length of the display system. Accordingly, the suspension clips 40*a*, 40*b* and 47*a*, 47*b* provide a sturdy display system which does not require additional fixtures for support and which prevents sagging of the channels.

To provide additional support and integrity for the display system, a pair of bottom support clips, indicated generally at 60 in FIG. 4, can be interconnected between the channels 15 and the support structure 18. The support clips 60 each include a first prong 62 and a foot 63 interconnected by a cross member 64. The first prong 62 is adapted to be received in the opening in the second attachment structure 36 on one of the channels; while the foot 63 is adapted to be received in a slot, for example slot 65, horizontally displaced from the second attachment structure on the support structure 18.

Accordingly, the channels 15 provide a low-cost display system for products which can be assembled at the point of display, and in which additional channels can be coupled to the display system, depending on the quantity of products to be displayed.

Figure 6:
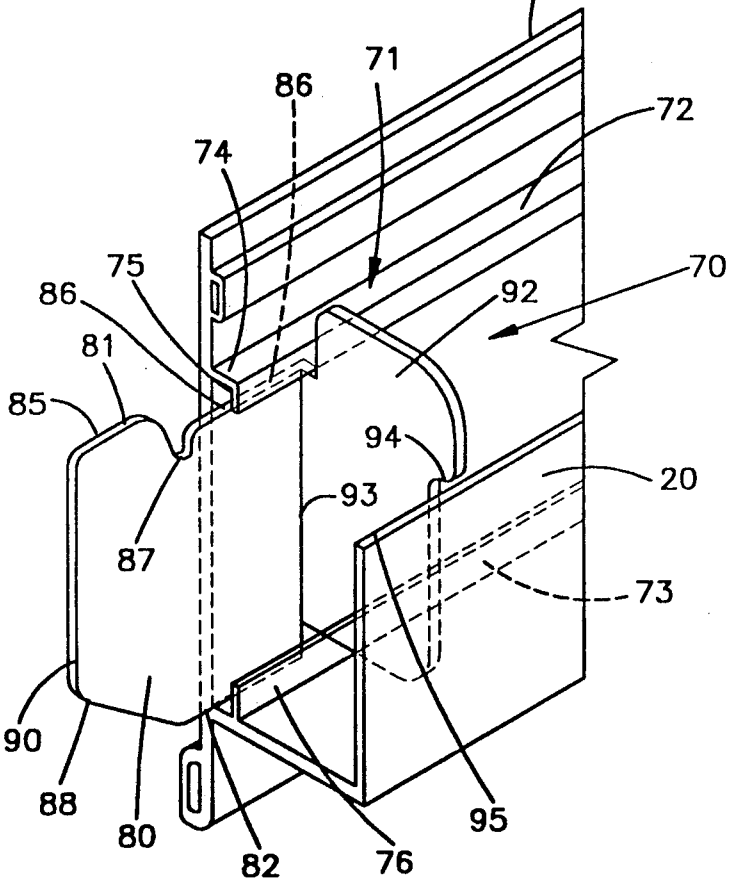
FIG. 6 is a perspective view of a divider member for the display system illustrating one method for installing the divider member in the divider structure.

Additionally, referring now to FIG. 6, a plurality of divider members, for example as indicated generally at 70, can be introduced into the display system to divide the channels into plural sections for the neat and orderly arrangement of products. To this end, the rear rail 22 of each channel includes a divider structure, indicated generally at 71. The divider structure comprises a pair of opposed top and bottom divider channels 72, 73 respectively, formed along the length of each channel. In particular, the top divider channel 72 is formed integrally with the rear wall 22 of the channel 15 and has a horizontally extending portion 74 and a downwardly extending lip 75 which extend along the length of the channel 15.

A bottom divider channel 73 is formed opposite the top divider channel 72 and comprises an upwardly extending member 76 formed in one piece with the bottom shelf 24 and extending therealong. The top and bottom divider channels 72, 73 are formed in the rear rail 22 during the extrusion process using techniques known to those of ordinary skill in the art.

The divider structure 71 is adapted to receive the divider member 70 at selected locations along the channel. The divider member 70 comprises a first attachment portion 80 having top and bottom edges 81, 82, respectively, which are adapted to be received between the divider channels 72, 73. The top edge 81 of the divider member includes a first shoulder portion 85 and a second shoulder portion 86, interconnected by a U-shaped portion 87. The bottom edge 82 of each divider member includes a tapered section 88 interconnecting the bottom edge 82 of the divider with the front edge 90 of the divider member.

The divider member 70 further includes an outwardly projecting portion 92 pivotally attached along a score line 93 and extending substantially perpendicular to the attachment portion 80. The outwardly projecting portion 92 includes a shoulder 94 which is adapted to rest upon the upper edge 95 of the front rail 20 when the divider member is located between the top and bottom divider channels.

The divider member 70 is adapted to be installed along selected locations of the channel 15. To this end, each divider member 70 can be inserted in either side of a channel such that the top and bottom edges 81, 82, respectively, are engaged and supported between the top and bottom divider channels 72, 73.

Figure 7:
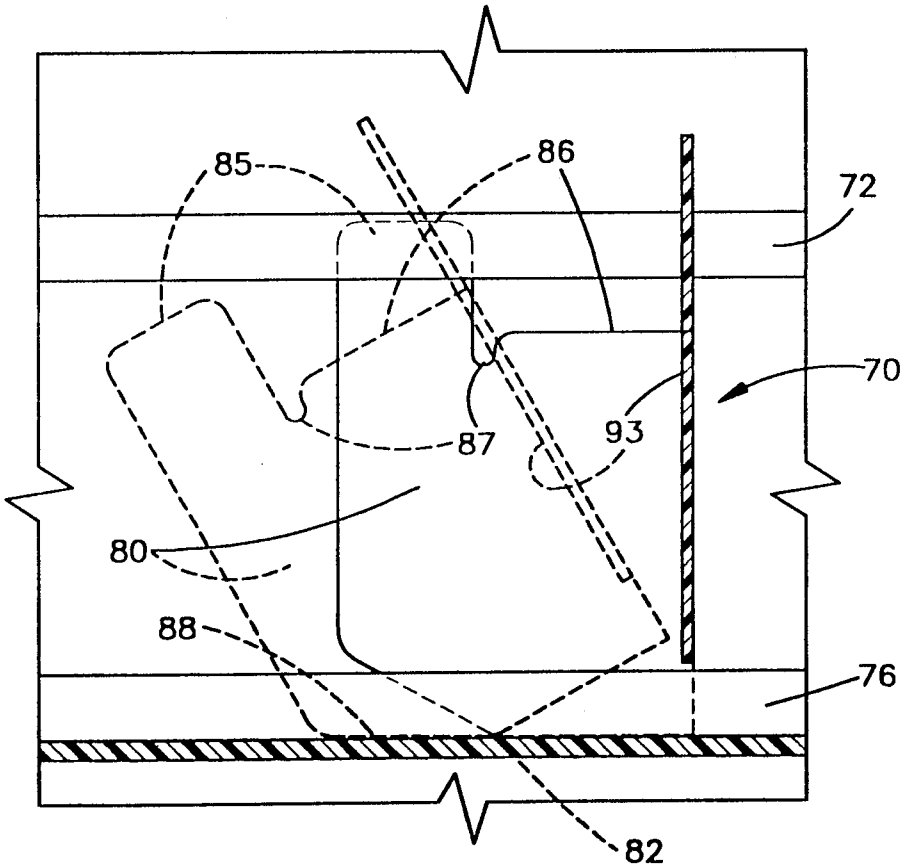
FIG. 7 is a plan view of the display system illustrating another method for installing the divider member in the divider structure.

Alternatively, as illustrated in FIG. 7, each divider member 70 can be tilted and inserted between the divider channels 72, 73 such that the tapered section 88 and the second shoulder portion 86 of the divider member are received between the divider channels; and then the divider member can be twisted into a normal orientation for support along the divider structure.

Figure 8:
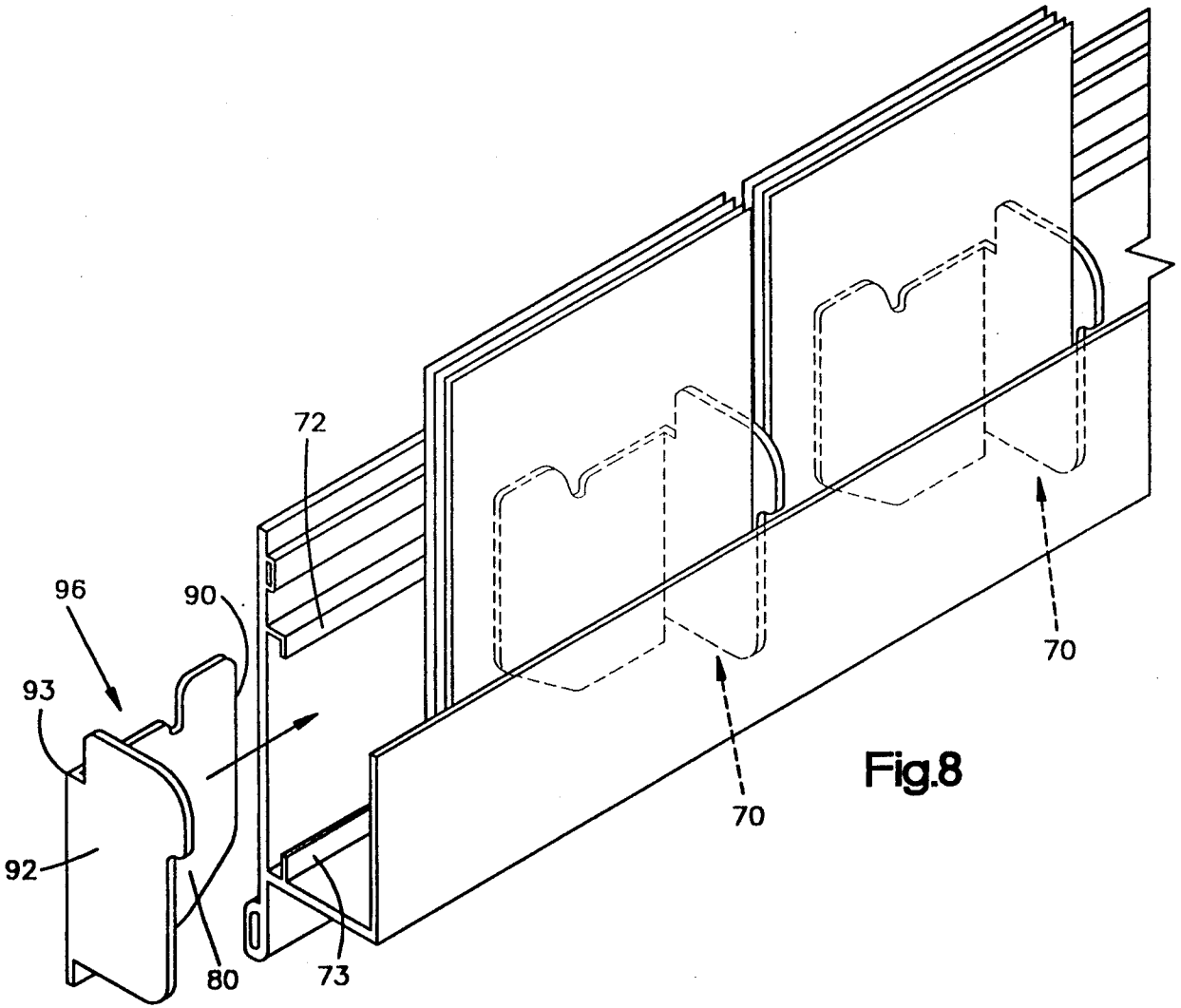
FIG. 8 is a perspective view of the display system illustrating divider members separating products along the length of a channel.

As illustrated in FIG. 8, a plurality of divider members can be located along the divider structure to separate stacks of products on the channel. Additionally, an end divider member, indicated generally at 96, can be included in the display system by folding the outwardly projecting portion 92 around the score line 93, and initially inserting the front edge 90 of the attachment portion 80 between the divider channels 72, 73.

Accordingly, the present invention provides a low-cost display system which can be conveniently assembled at the point of display. The display system is adjustable, that is, the number of channels can be increased or decreased depending on the quantity of products being supported on the display system. Further, the channels are supported in adjacent relation without the need for additional fixtures to prevent sagging. Moreover, divider members can be selectively located along the length of each channel to divide the channels into a plurality of sections for the neat and orderly arrangement of products.

While the foregoing disclosure depicts the preferred embodiment of the present invention, there are other ways contemplated for providing the features and advantages of the invention. For example, the top and bottom divider channels can be formed on the inside surface of the front rail of each channel, rather than on the rear rail, to separate each channel into plural sections. Moreover, it is believed that additional modifications of the present invention will become apparent to those of ordinary skill in this art.

What is claimed is:

1. A display system, comprising:

a support member attached to a vertical structure, a pair of laterally extending channels adapted to be supported in adjacent, side-by-side relation. each of said channels designed to support products in an upright orientation, each of said channels also including a first attachment structure and a second attachment structure separate from said first attachment structure, a first clip having a pair of prongs interconnected by a cross member, one of said prongs of said first clip adapted for attachment to said first attachment structure on one channel, and the other of said prongs of said first clip adapted for attachment to said first attachment structure of the other channel, and a second clip also having a pair of prongs interconnected by a cross member, one of said prongs on said second clip adapted for attachment to said second attachment structure on one channel, and the other of said prongs adapted for attachment to said second attachment structure on the other channel, said one prong on said first clip further adapted for attachment to said support member to support said pair of adjacent channels on said vertical structure.

2. A display system as in claim 1, wherein each of said channels has a pair of rails projecting outwardly from a bottom surface, said first and second attachment structure being formed in one of said rails.

3. A display system as in claim 1, wherein first attachment structure is formed in said one rail at a location spaced from said bottom surface, and said second attachment structure is formed in said one rail at a location proximate said bottom surface.

4. A display system as in claim 1, wherein each of said channels further includes a divider structure formed with one of said rails, said divider structure adapted to receive a divider member.

5. A display system as in claim 4, wherein said divider member comprises an attachment portion adapted to be received within said divider structure, and a divider portion projecting outwardly from said attachment portion to divide a channel into plural sections.

6. A display system as in claim 1, further including a bottom suspension clip adapted for attachment between said second attachment structure on one of said pair of laterally extending channels, and said vertical structure.

7. A display system as in claim 1, further including a third and fourth clip adapted to couple said pair of laterally extending channels in substantially adjacent, side-by-side relation, said third clip having a pair of prongs interconnected by a cross member, one of said prongs on said third clip adapted for attachment to said first attachment structure on the one channel, and the other of said prongs adapted for attachment to said first attachment structure on the other channel, and said fourth clip having a pair of prongs interconnected by a cross member, one of said prongs on said fourth clip adapted for attachment to said second attachment structure on the one channel, and the other of said prongs adapted for attachment to said second attachment structure on the other channel.

8. A display system as in claim 7, wherein each of said first and second attachment structures includes an opening formed on opposite ends of each channel, said first and third clips adapted to be received in openings formed in said first attachment structure along opposite ends of each channel, and said second and fourth suspension clips adapted to be received in openings formed in said second attachment structure along opposite ends of each channel.

9. A display system as in claim 8, wherein said attachment structures are formed in the rear rail of each channel.

10. A display system as in claim 9, wherein said channels are linearly extruded in one piece.

11. A method for assembling a display system, comprising:

aligning first and second laterally extending channels having front and rear outwardly extending rails in side-by-side relation such that an outer surface of the front rail on one channel is adjacent an outer surface of the rear rail of the other channel, inserting one prong of a first clip into a first attachment structure on one rail of the one channel, inserting another prong of the first clip into a first attachment structure on one rail of the other channel, inserting one prong of a second clip into a second attachment structure on the one rail of the one channel, inserting another prong of the second suspension clip into a second attachment structure on the rear rail of the other channel, mounting said first clip on a vertical surface to support said channels on said surface.

12. An assembly of elements, comprising:

a pair of channels, each channel comprising a bottom surface having a pair of rails projecting outwardly from the surface, said pair of rails and bottom surface defining a channel for support and display of products, at least one of said rails on each channel including a first attachment structure, at least one clip adapted to couple the attachment structure on one channel to the first attachment structure on the other channel to support one channel in side-by-side relation to the other channel.

13. An assembly of elements as in claim 12, wherein one of said rails is parallel to the other of said rails.

14. An assembly of elements as in claim 13, wherein said bottom surface is formed at an acute angle to one of said rails, and at an obtuse angle to the other of said rails.

15. An assembly of elements as in claim 14, wherein said bottom surface and said rails form a substantially J-shaped design in cross section.

16. An assembly of elements as in claim 15, wherein said bottom surface and said pair of rails are formed in one piece.

17. An assembly of elements as in claim 16, wherein said pair of rails are linearly extruded.

18. An assembly of elements as in claim 12, wherein said pair of rails comprise a front and rear rail, said rear rail of one channel being supported in side-by-side relation to the front rail of the other channel.

19. An assembly of elements as in claim 18, wherein said first attachment structure is formed in the rear rail of each channel.

20. An assembly of elements as in claim 19, wherein at least two clips are adapted to couple the first attachment structure of one channel to the first attachment structure on the other channel.

21. An assembly of elements as in claim 20, further including a second attachment structure formed on one of said rails on each channel.

22. An assembly of elements as in claim 21, wherein said second attachment structure is formed in said rear rail of each channel.

23. An assembly of elements as in claim 22, wherein at least two clips are adapted to couple the second attachment structure of one channel to the second attachment of the other channel.

24. A display system as in claim 12, wherein each of said channels further includes a divider structure formed with one of said rails, said divider structure adapted to receive a divider member.

25. A display system as in claim 24, wherein said divider member comprises an attachment portion adapted to be received within said divider structure, and a divider portion projecting outwardly from said attachment portion to divide a channel into plural sections.

26. A display system as in claim 12, wherein two clips are adapted to couple the first attachment structure on one channel to the first attachment structure on the adjacent channel.

27. A display system as in claim 26, wherein each clip includes a pair of prongs interconnected by a cross member.

28. A display system, comprising:

a support member attached to a vertical structure, a pair of laterally extending channels supported in adjacent, side-by-side relation, each of said channels designed to support products in an upright orientation, each of said channels also including a first attachment structure and a second attachment structure separate from said first attachment structure, a first clip attached between said first attachment structure on one channel and said first attachment structure on the other channel, a second clip attached between said second attachment structure on the one channel and said second attachment structure on the other channel, said first and second clips coupling said channels together in adjacent side-by-side relation, and said first clip further attached to said support member to suspend said pair of adjacent channels from said vertical structure, said suspended channels tending to expand said first clip and to compress said second clip.

* * * * *